US005993569A

United States Patent [19]

Simon et al.

[11] Patent Number: 5,993,569

[45] Date of Patent: Nov. 30, 1999

[54] SILICON-CONTAINING IRON POWDERS

[75] Inventors: Joachim Simon, Mannheim; Reinhold Schlegel, Hassloch; Bernd Leutner, Frankenthal, all of Germany

[73] Assignee: BASF Aktiengesellschaft, Ludwigshafen, Germany

[21] Appl. No.: 09/060,175

[22] Filed: Apr. 15, 1998

[30] Foreign Application Priority Data

Apr. 22, 1997 [DE] Germany ..... 197 16 882

[51] Int. Cl.[6] ..... H01F 1/04

[52] U.S. Cl. ..... 148/307; 148/306

[58] Field of Search ..... 148/306, 307

[56] References Cited

U.S. PATENT DOCUMENTS 4,468,474 8/1984 Gupta et al. ..... 502/5
4,558,017 12/1985 Gupta et al. ..... 501/96

OTHER PUBLICATIONS

Frurip et al., *J. of Non–Crystalline Solids*, 68, 1984, pp. 1–10.

X. Gao, *J. of Inorganic Materials*, vol. 7, No. 4, abstract only Dec. 1992, pp. 429–434.

Syrkin et al., *Soviet Powder Metallurgy and Metal Ceramics*, 1970, pp. 447–449.

*Chem. Abst.*, vol. 107, No. 10, Sep. 7, 1987, AN 79913, XP 002075742.

*Primary Examiner*—Paul J. Killos
*Assistant Examiner*—J. Parsa
*Attorney, Agent, or Firm*—Keil & Weinkauf

[57] ABSTRACT

The invention relates to a method for preparing silicon-containing iron powders by thermal decomposition of a gas mixture comprising iron pentacarbonyl and, as a volatile silicon compound, a silane or a halogen-free organosilane in which the gas mixture flows through a heated reaction chamber and heating of the gas mixture is effected by thermal conduction. The silicon-containing iron powders obtained are distinguished by a particularly low impurity element content. The silicon-containing iron powders can be used for the fabrication of cores, magnets and radar-absorbing materials.

7 Claims, No Drawings

SILICON-CONTAINING IRON POWDERS

The invention relates to silicon-containing iron powder, to methods for preparing it, to an apparatus for implementing the method and to the use of the silicon-containing iron powder.

For a long time, the thermal decomposition of iron pentacarbonyl in the gas phase has provided a simple, cost-effective method, practicable on a large industrial scale, for preparing highly pure fine iron powders. Carbonyl iron powder thus prepared is used in a multiplicity of industrial applications. Major significance has been attained by carbonyl iron powder, for example, in the field of powder metallurgy, which is based on the purity, the low formation temperature, the small size, the spherical shape and the attendant particularly good sinterability of the powder particles. Owing to its favorable magnetic characteristics, carbonyl iron powder is also used on a large scale for the fabrication of electronic components. Mixed with an inert binder, the powders are processed by compression molding or by injection molding to produce plastic-bound powdered-iron cores. Such cores contain carbonyl iron powder as a fine-grained ferromagnetic, whose insulent individual particles are separated from one another by a thin layer of an. The more complete the insulation of these particles having as small a size as possible, the lower will, under otherwise identical conditions, be the losses due to eddy currents in the powdered-iron core. Since in the case of carbonyl iron powder the individual particles have an ideal spherical shape, electrical insulation is simpler and more reliable than in the case of particles having irregular corners and edges. In the case, in particular, of high-pressure molding the insulating layer is less readily damaged, and no metallic contacts are formed between the grains. Carbonyl iron powder is further used for the fabrication of electromagnetic shields.

The admixture of silicon provides an additional option of influencing the magnetic characteristics of the carbonyl iron powders. For the above-described applications in electrical engineering, for example, a certain silicon content of the iron powders may be desirable, since iron-silicon alloys having a silicon content of from 1 to 4%, while having a similarly high permeability, exhibit significantly lower hysteresis losses and coercivities than pure iron. Moreover, iron-silicon alloys are more resistant to environmental effects than pure iron.

Finely disperse metal powders are also potentially suitable as catalysts. The literature, discloses for example, the catalytic effect of silicon-iron alloys in the hydrogenation of CO in the Fischer-Tropsch process.

D. J. Frurip et al., Journal of Non-Crystalline Solids 68 (1984), p. 1, describe the preparation of amorphous ferrosilicon particles having a size of from 5 to 30 nm by laser pyrolysis of a gaseous mixture of $Fe(CO)_5$, $SiH_4$ and $SF_6$. In this process the absorption of IR laser light by $SiH_4$ and $SiF_6$ gives rise to local heating of the gas mixture to from 350 to 600° C. and consequently to thermal decomposition of the components.

X. Gao et al., Journal of Inorganic Materials, 7 (1992), pp. 429 to 434, describe a similar continuous process for preparing ultrafine iron-silicon particles by means of a CW—$CO_2$ laser, the process not requiring the addition of $SF_6$ as a photosensitive agent. Formed inter alia are particles having the composition $Fe_3Si$, $Fe_2Si$, $Fe_5Si_3$, FeSi and $FeSi_2$.

U.S. Pat. No. 4,468,474 describes a method for preparing catalytically active iron-silicon alloys by laser pyrolysis of a gaseous mixture of silanes, halosilanes with organoiron compounds (iron pentacarbonyl, iron acetylacetonate and ferrocene) and hydrocarbons. Powders of iron-silicon-carbon alloys comprising from 5 to 15 atomic % of iron, from 65 to 88 atomic % of silicon and from 2 to 30 atomic % of carbon or iron-silicon alloys comprising from 10 to 30 atomic % of iron and from 70 to 90 atomic % of silicon are obtained. The powders selectively catalyze the hydrogenation of the CO to $C_2$–$C_6$ alkanes.

A drawback of the abovementioned processes is the use of high-power infrared lasers for heating the gas mixture, as a result of which the process becomes complicated and expensive and consequently seems unsuitable for use on a large industrial scale.

V. G. Syrkin et al., Soviet Powder Metallurgy and Metal Ceramics 1970, pp. 447 to 449, describe the use of certain additives for controlling the particle size during the preparation of iron powder by thermal decomposition of iron pentacarbonyl. Additives used are, inter alia, organosilicon compounds such as tetraethoxysilane, triethylsilane, ethyldichlorosilane and methylethyldichlorosilane. In the presence of the said additives, iron powders having a mean particle size around 2.5 $\mu$m or iron wool are formed. If tetraethoxysilane and ethyldichlorosilane are used, the powders have a low silicon content of 0.35 or 0.09 wt %, if triethylsilane and methylethyldichlorosilane are used, the silicon content of the powders obtained is stated to be 0.

No information is provided on the quantities used of organosilicon compound.

SU-A 344 014 describes a process for preparing finely disperse powders of iron-silicon alloy, the process involving the introduction of a solution of $(SiCl_3)_2Fe(CO)_4$ in benzene as a mist into a reaction chamber heated to 350° C. Optionally, the solution additionally contains iron pentacarbonyl. Powders comprising 50 wt % of iron and 50 wt % of silicon are formed, and if iron pentacarbonyl is also used, powders comprising 94 wt % of iron and 6 wt % of silicon are formed. A drawback of this process is the use of halogen-containing starting materials, given the attendant corrosion and disposal problems. In particular, the use of halogen-containing starting materials may lead to the formation of salts. Moreover, the process requires the use of large amounts of solvent.

It is an object of the present invention to provide, for numerous applications, a method for preparing silicon-containing iron powders having a silicon content which can be varied within wide limits and having a small proportion of minor constituents, which exhibit the advantageous characteristics of the carbonyl iron powders in particular with respect to the further processing thereof. In particular it is an object of the invention to provide an uncomplicated method, which can be implemented cost-effectively, for preparing silicon-containing iron powders on the basis of the processes for the preparation of carbonyl iron powder.

The invention is based on the known method for preparing silicon-containing iron powders by thermal decomposition of a gas mixture comprising iron pentacarbonyl and a volatile silicon compound, in which the gas mixture flows through a heated reaction chamber and heating of the gas mixture is effected by thermal conduction. The invention is distinguished by the volatile silicon compound used being a silane or a halogen-free organosilane with the exception of triethylsilane and tetraethoxysilane.

Suitable silanes include silanes which are gaseous at room temperature or volatile, such as monosilane $SiH_4$, disilane $Si_2H_6$, trisilane $Si_3H_8$ and all constitutionally isomeric tetrasilanes $Si_4H_{10}$, pentasilanes $Si_5H_{12}$ and hexasilanes $Si_6H_{14}$. Suitable organosilanes further include mono- to tetrasubstituted organosilanes which are gaseous at room temperature or volatile and are derived from monosilane, where the substituents, which may be identical or different, can be alkyl, alkoxy or aryl groups or silyl groups substituted by hydrogen, alkyl, alkoxy or aryl groups. Examples are: methylsilane, dimethylsilane, trimethylsilane, tetramethylsilane, ethylsilane, diethylsilane and tetraethylsilane. It is also possible to use aminosilanes, e.g. $H_3Si—NH_2$, $(H_3Si)_2NH$ and $(H_3Si)_3N$. A preferred embodiment makes use of monosilane, $SiH_4$.

An advantage of the novel method is that the silicon content of the novel silicon-containing iron powders can be varied within wide limits and can be adjusted systematically by selecting the composition of the gas mixture. In principle the ratio between iron pentacarbonyl and the volatile silicon compound in the gas mixture can be chosen at will, iron pentacarbonyl as a rule being used in excess, in terms of weight. Preferably, however, up to 50 wt %, particularly preferably from 0.4 to 25 wt % of the volatile silicon compound, based on the sum of iron pentacarbonyl and the volatile silicon compound, are used.

Iron pentacarbonyl and the volatile silicon compound can be used in the gas mixture either on their own or in a mixture with further gases. Thus the gas mixture may additionally contain, as further gases, CO, $H_2$ and ammonia which may be present on their own or together. In a preferred embodiment the gas mixture additionally contains carbon monoxide. Preferably the carbon monoxide proportion is up to 9 g vol %, particularly preferably from 60 to 98 vol %. If ammonia is used at the same time, products having an increased nitrogen percentage can be obtained. Preferably up to 10 vol % of ammonia are used, particularly preferably from 1 to 5 vol %. The concomitant use of ammonia also has the advantage that ammonia probably accelerates the decomposition of iron pentacarbonyl into iron and carbon monoxide. In a further embodiment hydrogen is additionally present in the gas mixture. Preferably the hydrogen content of the gas mixture is up to 60 vol %, particularly preferably from 1 to 40 vol %.

The silicon-containing iron powders prepared according to the invention may have a silicon content of up to 25 wt %. Preferably the silicon content is from 0.5 to 25%, particularly preferably from 0.5 to 10%, especially from 1 to 4 wt %. The silicon content can be determined in accordance with known methods of elemental analysis, for example by X-ray microdomain analysis from SEM exposures.

The silicon-containing iron powder may contain minor constituents, in particular oxygen, carbon, hydrogen and nitrogen. The oxygen content may be up to 30 wt %, preferably being below 10 wt %, particularly preferably from 0.1 to 5 wt %. The carbon content may be up to 10 wt %, preferably being below 8 wt %, particularly preferably from 0.1 to 7 wt %. The nitrogen content may be up to 2 wt %. If ammonia is also used, it is preferably from 0.5 to 2 wt %, without the use of ammonia preferably below 0.5 wt %. The hydrogen content may be up to 1 wt %, preferably being below 0.5 wt %.

A further advantage of the novel method is the particularly low impurity metal level of the silicon-containing iron powders. The silicon-containing iron powders obtained according to the invention preferably have the following level of impurity elements: nickel<100 ppm, chromium<150 ppm, molybdenum<20 ppm, arsenic<2 ppm, lead<10 ppm, cadmium<1 ppm, copper<5 ppm, manganese<10 ppm, mercury<1 ppm, zinc<10 ppm, sulfur<10 ppm. The impurity element level can be determined by means of atomic absorption spectral analysis.

Another advantage is that the silicon-containing iron powder is produced, via the novel method, in a finely disperse form and to that extent a mechanical aftertreatment, for example by grinding, can be dispensed with. The silicon-containing iron powder is produced, in the reaction, in the form of essentially spherical particles having a mean diameter from 0.005 to 10 $\mu$m, which may be agglomerated to form threads or nodule-like aggregates. Preferably the mean diameter of the essentially spherical particles is from 0.01 $\mu$m to 5 $\mu$m. The BET surface area of the particles is preferably up to 30 $m^2/g$. The bulk density of the novel powders, which decreases with increasing silicon content, is preferably from 0.4 to 4 $g/cm^3$.

The reaction is preferably effected continuously in a heated reaction chamber through which the gas mixture is flowing. The reaction can be carried out, for example, in a heatable decomposition apparatus as is used for the preparation of carbonyl iron powder by thermal decomposition of iron pentacarbonyl and is described in Ullmann's Encyclopedia of Industrial Chemistry, 5th edition, volume A14, page 599. Such a decomposition apparatus comprises a tube made of a heat-resistant material such as quartz glass or V2A steel in a preferably vertical position, which is surrounded by a heating arrangement, for example comprising strip heaters, heating wires or a heating jacket through which a hearing medium is flowing. Preferentially, the heating arrangement, for the purpose of establishing a low-temperature zone and a higher-temperature zone, is subdivided into at least 2 segments. The gases are premixed and preferably introduced from above into the decomposition tube, the gas mixture first passing the low-temperature zone. The temperature in the bottom section of the tube is preferably at least 20° C. higher than in the top section of the tube. The silicon-containing iron powder formed is precipitated from the gas stream in accordance with known methods utilizing gravity, centrifugal force or by means of a filter arrangement. This can be effected, for example, by the gas stream passing through a precipitation vessel and being deflected there. In the case of larger particles the separation can also readily be effected by the particles being is allowed to trickle out from the decomposition apparatus and being collected in a receiver. To account for the possibility of solid particles being entrained by the gas flow, a filter arrangement is preferably employed in addition.

The reaction in the decomposition apparatus is preferably effected at from 200 to 600° C., particularly preferably at from 250 to 350° C. The reaction can be carried out at pressures of up to 40 bar. The pressure is preferably between 1 and 2 bar absolute. A further advantage of the novel method is that it is possible, by selecting the reaction parameters such as pressure, temperature and flow velocity and also the gas composition, to vary the mean particle size of the powders.

The silicon-containing iron powders obtained in accordance with the method described may be largely freed from carbon, oxygen and nitrogen by being reduced in the heat in a hydrogen stream. The powders are preferably reduced at from 300 to 600° C., particularly preferably at from 400 to 500° C. The reduced powders may have a carbon level of less than 0.05 wt %, a nitrogen level of less than 0.01 wt % and an oxygen level of less than 0.2 wt %.

The novel silicon-containing iron powders are particularly suitable for applications in electronics or electrical engineering, both reduced and nonreduced powders being available for use. For example, the novel silicon-containing iron powder may be used for the fabrication of cores or magnets. Particularly advantageous are the distinctly lower hysteresis losses and coercivities of the iron-silicon alloy. The silicon-containing iron powder can be processed like carbonyl iron powder by being compounded, for example, with a curable binder, e.g. a phenolic resin or an epoxy resin, being granulated and, in dry form, being compression-molded to give the desired shaped articles, rings, rods and screw cores. These are then cured thermally. Such plastic-bound magnet cores can be fabricated by compression molding, but also in an injection-molding process. A major advantage of the powder cores thus fabricated is that the powder is very fine. By means of suitable insulation it is thus possible to achieve a major reduction in the eddy current losses with respect to powder cores which are fabricated from coarser powder. This reduction in the eddy current losses manifests itself in improved quality. Particularly high quality is achieved if the insulation is so thick that no contact occurs between the individual primary powder particles. Insulation of the powder particles with a constant insulating layer can be effected, for example, by the silicon-containing iron powder being treated with a dilute solution of phosphoric acid in an organic solvent, an iron phosphate layer being formed in the process on the surface of the particles.

It is further possible for the novel silicon-containing iron powders to be processed into microwave-absorbing or radar-absorbing materials. To this end the powders are introduced into plastic or rubber-like materials or alternatively into coating systems. The novel silicon-containing iron powder is particularly suitable as an absorber for electromagnetic radiation in the frequency range of from 1 to 100 gigahertz.

The silicon-containing iron powders can further, owing to their high silicon content and their large specific surface area, be used as catalysts for the hydrogenation of carbon monoxide in the Fischer-Tropsch process.

The invention is illustrated in more detail by the following examples:

EXAMPLES 1 TO 13

The apparatus for the thermal decomposition of iron pentacarbonyl [$Fe(CO)_5$] and silane ($SiH_4$) comprises a decomposition tube of V2A steel having a length of 1 m and an internal diameter of 20 cm. The decomposition tube is heated in such a way that the temperature in the bottom third is about 20° C. higher than the temperature $T_1$ in the upper section of the tube. The $Fe(CO)_5$ introduced in liquid form is evaporated in an electrically heated feed vessel, and the vapor is introduced, together with $SiH_4$ (0–60 1/h), $H_2$ (0–500 1/h), $NH_3$ (0–150 1/h) and possibly CO (0–100 1/h), into the decomposition tube from above. The formation of the silicon-containing iron powder takes place in the decomposition tube, CO and $H_2$ being liberated. The silicon-containing iron powder formed, together with the gas stream, passes into a precipitation vessel where it is separated from the gas stream by the latter being deflected. Any solid particles remaining in the gas stream are retained by a filter cartridge. The silicon content of the iron powders is determined by elemental analysis and, within the limits of analytical accuracy, corresponds to the amount of monosilane used. By means of IR spectrometry, about 2 ppm of $SiH_4$ can still be detected in the waste gas, so that virtually complete conversion of the silane can be inferred. The elemental composition of the particles was determined by means of AAS (atomic adsorption spectroscopy), and their specific surface area (BET surface area) was measured by nitrogen adsorption in accordance with DIN 66 132.

Comparative Example C1:

The method was implemented as described above, except that no $SiH_4$ was used.

The reaction conditions and the characterization of the process products are shown in the following table.

| Ex. No. | $Fe(CO)_5$ [g] | $SiH_4$ [g] | $T_1$ [° C.] | Fe content [wt %] | Si content [wt %] | C content [wt %] | H content [wt %] | N content [wt %] | BET surf. area [$m^2$/g] | Use of 5 vol % of $NH_3$ |
|---|---|---|---|---|---|---|---|---|---|---|
| 1 | 920 | 4 | 270 | 95.6 | 0.7 | 1.4 | <0.5 | 0.7 | 0.5 | yes |
| 2 | 900 | 4 | 270 | 93.4 | 1.0 | 1.6 | 0.3 | 1.0 | 2.2 | yes |
| 3 | 900 | 5 | 270 | 93.0 | 1.2 | 2.7 | <0.5 | 0.5 | 3.8 | yes |
| 4 | 800 | 8.5 | 275 | 89.2 | 1.7 | 2.7 | n.d. | <0.2 | 5.5 | — |
| 5 | 1000 | 10 | 270 | 90.0 | 1.8 | 2.2 | n.d. | n.d. | 4.3 | — |
| 6 | 900 | 7 | 270 | 89.0 | 2.0 | 2.3 | <0.5 | 0.9 | 19.9 | yes |
| 7 | 900 | 9 | 260 | 89.1 | 2.4 | 2.7 | <0.5 | 1.3 | 21.5 | yes |
| 8 | 900 | 9 | 260 | 87.6 | 2.5 | 3.0 | <0.5 | 1.0 | 22.4 | yes |
| 9 | 900 | 8 | 280 | 86.7 | 2.8 | 3.2 | <0.5 | 1.0 | 16.4 | yes |
| 10 | 900 | 9 | 265 | 85.5 | 3.1 | 3.4 | <0.5 | <0.5 | 25.3 | — |
| 11 | 630 | 11 | 335 | 80.5 | 4.8 | 6.6 | <0.5 | <0.2 | 28.0 | — |
| 12 | 520 | 13 | 335 | 77.5 | 5.0 | 6.3 | <0.5 | <0.2 | 33.1 | — |
| 13 | 920 | 17 | 260 | 76.1 | 7.6 | 5.6 | <0.5 | <0.5 | 20.5 | — |
| C1 | 660 | — | 200 | 98.7 | <0.05 | 0.7 | <0.5 | 0.55 | 0.2 | yes (+50 vol % of $H_2$) |

We claim:

1. A process for preparing a silicon-containing iron powder by thermal decomposition of a gas mixture, which process comprises flowing a gas mixture comprising iron pentacarbonyl and a volatile silicon compound selected from the group consisting of a silane and a halogen-free organosilane, with the exception of triethylsilane and tetraethyoxysilane, through a heated reaction chamber;

heating the gas mixture by thermal conduction; and recovering the silicon-containing iron powder;

wherein the silicon-containing iron powder has a silicon content of from 0.5 to 25 wt %.

2. The process of claim 1, wherein the volatile silicon compound is $SiH_4$.

3. The process of claim 1, wherein the decomposition is carried out in the presence of ammonia and/or hydrogen.

4. The process of claim 1, wherein the gas mixture is heated to a temperature of from 200 to 600° C.

5. The process of claim 1, wherein the decomposition is carried out at a pressure of from 1 to 2 bar absolute.

6. The process of claim 1, wherein the silicon-containing iron powder obtained is reduced with gaseous hydrogen after the decomposition.

7. Silicon-containing iron powder comprising spherical particles having a diameter of from 0.005 to 10 $\mu$m or aggregates thread of said particles prepared according to the process of claim 1.

* * * * *